US006986422B2

(12) United States Patent
Boatwright

(10) Patent No.: US 6,986,422 B2
(45) Date of Patent: Jan. 17, 2006

(54) CARD SLOT

(76) Inventor: Donald Jeffrey Boatwright, 5710 Mount Holly Huntersville Rd., Charlotte, NC (US) 28269

( * ) Notice: Subject to any disclaimer, the term of this patent is extended or adjusted under 35 U.S.C. 154(b) by 0 days.

(21) Appl. No.: 10/079,279

(22) Filed: Feb. 20, 2002

(65) Prior Publication Data

US 2003/0155256 A1 Aug. 21, 2003

(51) Int. Cl.
*B65D 85/00* (2006.01)

(52) U.S. Cl. ..... 206/449; 40/649; 206/39; 211/50; 220/481

(58) Field of Classification Search ..... 40/649, 40/654, 654.01; 206/39, 39.5–39.7, 425, 206/449, 451; 211/50; 220/480, 481
See application file for complete search history.

(56) References Cited

U.S. PATENT DOCUMENTS

| | | | | | |
|---|---|---|---|---|---|
| 1,368,084 | A | * | 2/1921 | Wolff | 40/649 |
| 2,261,838 | A | * | 11/1941 | McCracken | 73/650 |
| 2,262,058 | A | * | 11/1941 | Sinclair | 40/649 |
| 2,661,838 | A | * | 12/1953 | McCracken | 206/449 |
| 2,758,695 | A | * | 8/1956 | Symonds | 400/529 |
| 2,845,732 | A | * | 8/1958 | Nichols | 40/726 |
| 3,293,779 | A | * | 12/1966 | Vogeli, Sr. | 40/643 |
| 4,141,400 | A | * | 2/1979 | Mangan | 206/39.6 |
| 5,078,265 | A | * | 1/1992 | Fugit et al. | 206/39.6 |
| 5,775,522 | A | | 7/1998 | Martin | 211/184 |
| 5,992,618 | A | | 11/1999 | Joh | 206/39 |
| 6,052,933 | A | * | 4/2000 | Lytle | 40/711 |
| 6,099,188 | A | | 8/2000 | Ovitt | 402/79 |
| 6,105,294 | A | * | 8/2000 | Goodfellow | 40/654.01 |
| 6,189,689 | B1 | | 2/2001 | Toussaint | 206/308.3 |
| 6,203,878 | B1 | | 3/2001 | Davis | 428/83 |
| 6,250,004 | B1 | * | 6/2001 | Kondo | 40/642.02 |
| 6,374,523 | B1 | * | 4/2002 | Smith | 40/611.06 |
| 6,533,118 | B1 | * | 3/2003 | Nelson | 206/449 |

OTHER PUBLICATIONS

U.S. Appl. No. 10/012,863, filed Nov. 30, 2001, Boatwright /The Hot Clip.

* cited by examiner

*Primary Examiner*—Jim Foster

(57) ABSTRACT

An index card (10) holding device (12) to be attached to the surface of an object in a very convenient location which can be used to keep notes and record ideas when they are needed. The device allows the outer card being held to be in full view to the user. The outer end caps (18) are closely connected to the middle spacers (16) which are closely connected to the inner flat plate (14) in manner which creates a slot for holding 5 to 20 index cards (10) while allowing the cards to be removed and replaced easily. The thickness of the cards (10) being held creates the holding pressure against the inner flat plate piece (14) and the outer end caps (18). The shape of the middle spacers (16) prevents the cards from sliding out the back of the device. The present invention is attached to a surface by means of pressure sensitive adhesive.

1 Claim, 2 Drawing Sheets

CARD SLOT

FEDERALLY SPONSORED RESEARCH

Not Applicable

SEQUENCE LISTING OR PROGRAM

Not Applicable

BACKGROUND

1. Field of the Invention

The present invention relates to index cards, specifically to a device, which allows the user to view, hold, and store index cards in a very assessable manner with the outer card in full view. The present invention can be attached by means of a pressure sensitive adhesive to any object or surface for convenient access.

2. Description of Prior Art

Index card storage containers have been used for many years. Numerous index card storage boxes or containers exist for holding larger quantities of cards. Some smaller portable storage containers exist as described below. Most of these containers hold the index cards in a manner which does not allow the user to see what is on the outer card, and the containers are mostly a type of complete enclosure which does not allow the user to write on or read from the outer card while in the container.

Several types of holding devices which can store index cards have previously been proposed—for example, in U.S. Pat. No. 6,099,188 (2000), U.S. Pat. No. 6,189,689 (2001), U.S. Pat. No. 5,992,618 (1999), U.S. Pat. No. 5,775,522 (1998), and U.S. Pat. No. 6,203,878 (2001). All of these patents provide very useful capabilities for holding and storing index cards, but none of these or any others provide the capabilities of the present invention which allows index cards to be stored and retrieved with the top card in full view from an unlimited number of convenient locations to which the present invention can be attached.

U.S. Pat. No. 6,099,188 (2000) describes an organizer notebook for holding index cards which are simply inserted into a flap on the notebook. This devise also includes a cardholder which is retained in the notebook and is similar to a Rolodex. U.S. Pat. No. 6,189,689 (2001) describes a small carrier designed with a flap to retain small objects, such as index cards. U.S. Pat. No. 5,992,618 (1999) describes another type of pocket carrier for index cards which has a pivoting cover that snaps closed. U.S. Pat. No. 5,775,522 (1998) describes a device which is used as a card holder with integral divider. U.S. Pat. No. 6,203,878 B1 (2001) describes a device which when attached to a bulletin board can be used as a card holder. U.S. Pat. No. 6,189,689 (2001) is the only device mentioned above which can be attached to the surface of another article, but the outer card is not in view of the user nor can the outer card be written on while in the device.

No existing prior art provides the user with the number of possible uses for index cards as does the present invention. The present invention allows the user immediate access to index cards in numerous convenient locations when the device is attached to an object or surface at that location. The present invention secures and holds these cards with full view of the top card providing more advantages than a simple slot type holder which does not grip the cards in place. The present invention allows the user to write on the top card while this card remains in the devise. The present invention also allows the user much greater accessibility while removing or replacing cards into the device, since there is no flap or cover.

Objects and Advantages

Accordingly, the key object of the present invention is to provide a convenient means for a user to store and use index cards while being able to write on and read from the front card in the stack. Because the front card is still in full view, the user is able to be reminded of the cards and what is written on them. The advantages of being able to keep notes or cards immediately available in any location the user desires are numerous. The present invention allows students to study more effectively when using note cards; the device allows anyone who uses notebooks or planners to be more productive. The pressure sensitive adhesive on the back of the present invention allows the user to attach the device to most any object or surface. Some of the many examples of the advantages and possible uses for the present invention are:

a) access and view of index cards from inside notebook covers, binder covers, or book covers when the Card Slot is attached.
b) access and view of index cards from notebook inserts which can have one, two, or three Card Slots attached to each side of each insert page.
c) access and view of index cards from any surface at a work station which has the Card Slot attached, such as on the perimeter of a computer monitor or other objects near the user.
d) access and view of recipe index cards from a convenient location in the kitchen where the cook can see the recipe card.
e) access and view of index cards from a convenient location anywhere in the home such as the shop area, garage, or even the night stand next to a bed.
f) access and view of index/study cards from a convenient location in the users dormitory, such as next to the users desk or bed.
g) access and view of index cards while in a car, boat, or an airplane (for the pilot).

This invention allows users to be able to write down and remember important ideas and information when they think of them at any time in many convenient locations as determined by the user. Full view of the outer card also allows the user to be reminded of what is written on the card; so that what is not out of sight is not out of mind.

SUMMARY

The present invention allows the user to hold and store index cards in a very convenient manner. Index cards, typically 3" by 5" in size (but could be smaller or larger), can be placed into the holding slots of the device. The present invention which has a pressure sensitive adhesive on the back side allows the user to attach the device to most any surface area desired (even flexible surfaces). The user can easily remove or replace the cards with other cards (or the same cards) by simply slipping the existing card(s) out and sliding a new (or the same) card(s) back in place. The device can be constructed of inexpensive plastic or metal. The present invention comprises an inner flat plate piece slightly larger than the cards to be held to which two middle spacers are attached, and two outer end caps which are attached to the middle spacers. The flat plate piece, middle spacers, and the end caps provide a means for gripping the outer edges of the index cards while allowing the card(s) to be removed and put back into place. The gripping pressure results from the thickness of the cards which are stacked on top of each other to create a snug fit when placed into the edge slots of the device. The device can also be attached to Velcro which could then be attached to a surface for a more temporary application.

DRAWINGS

Drawing Figures

NUMERALS IN DRAWINGS

10 index cards

12 pressure sensitive adhesive surface

14 inner flat plate piece (one)

16 middle spacers (two each (mirror images), one each side)

18 outer end caps (two each, one each side)

DETAILED DESCRIPTION

Figure 1:
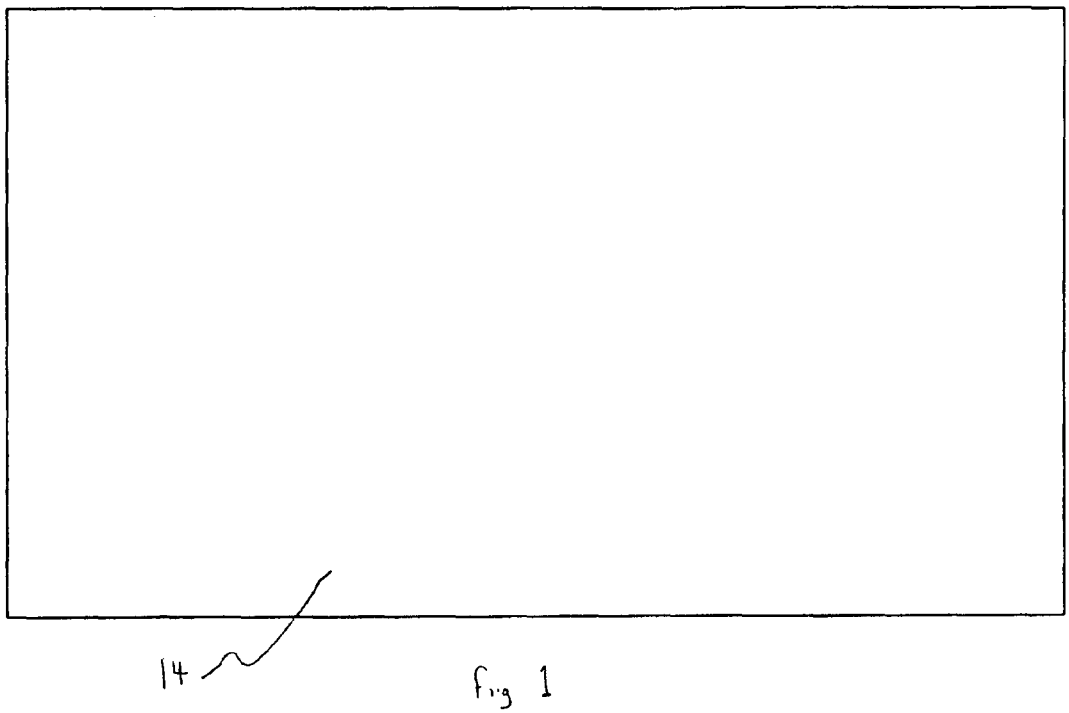
FIG. 1 shows a top side plan view of the inner flat plate piece which has pressure sensitive adhesive on the back side.
Figure 2:
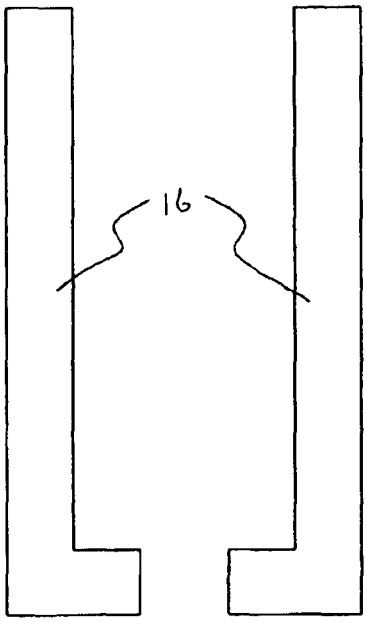
FIG. 2 shows a top side plan view of the two middle spacer pieces which are mirror images and which have pressure sensitive adhesive on both sides.
Figure 3:
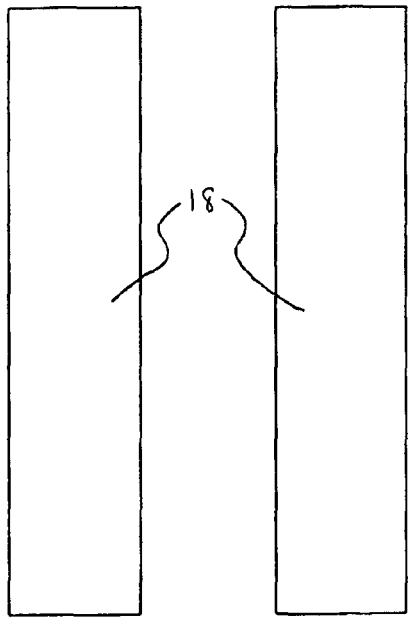
FIG. 3 shows a top side plan view of the two outer end cap pieces.
Figure 4:
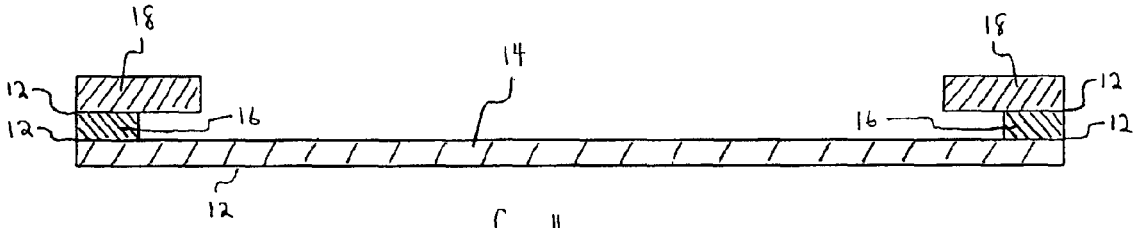
FIG. 4 shows a sectional view of the present invention which consists of all five pieces, and the resulting two end slot gaps where the edges of the index cards are inserted. The thickness of each piece is overemphasized for clarity.
Figure 5:
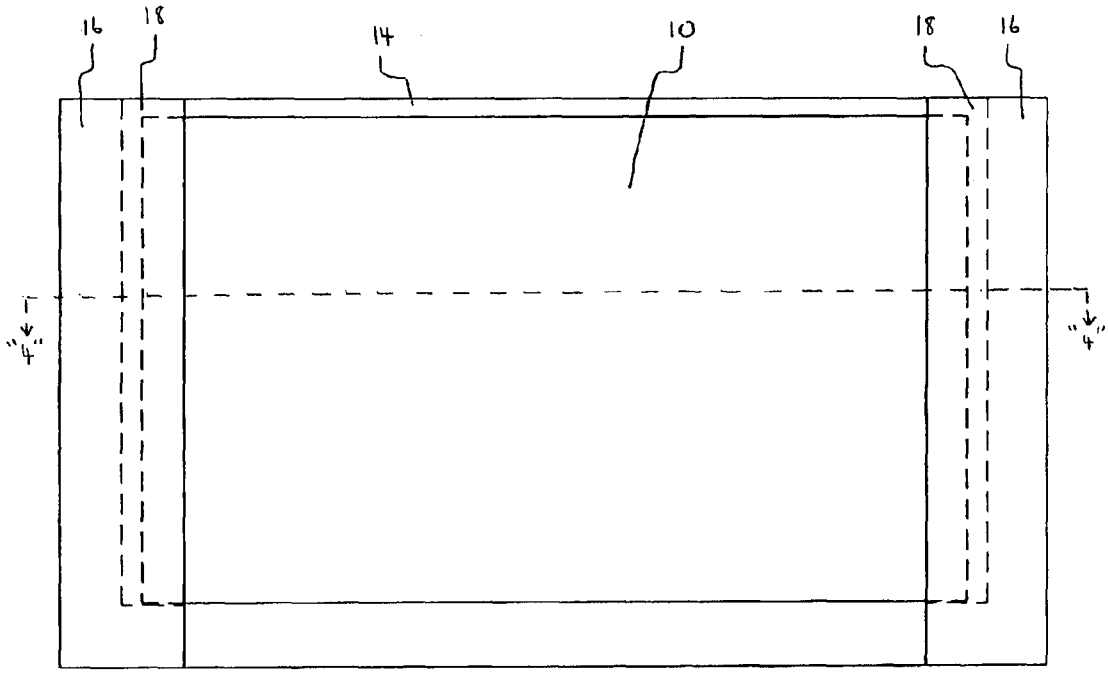
FIG. 5 shows a top side plan view of the present invention with all pieces in place along with index cards inserted into the device.

Description—FIGS. 1–5—Preferred Embodiment

A preferred embodiment of the present invention is illustrated in FIG. 1, FIG. 2, FIG. 3, FIG. 4, and FIG. 5. This embodiment consists of five pieces, including a flat plate piece 14, which is slightly larger than the card or cards 10 to be held, two middle spacer pieces 16, and two outer end cap pieces 18. These five components can be constructed of plastic or light weight metal such as aluminum. The inner flat plate piece 14 is approximately two to four inches in width by approximately four to six inches in length, and approximately 1/32nd to 1/16th inch in thickness. The two middle spacer pieces 16 are approximately two to four inches in length which is the same as the width of the flat plate piece, approximately one quarter to one half inch in width along the main body with an additional width of approximately one quarter to one half inch at one end, and approximately 1/32nd to 1/4th inch in thickness depending on how many cards are to be held in the device. The two outer end caps 16 are approximately two to four inches in length which is the same as the width of the flat plate piece 14, approximately one half to one inch in width, and approximately 1/32nd to 1/8th inch in thickness.

The middle spacer pieces 16 have pressure sensitive adhesive on both sides allowing the flat plate piece 14 and the outer end cap pieces 18 to be closely connected to the middle spacer pieces 16 in a sandwich like construction. The extended width of the end cap pieces 18 beyond the width of the middle spacer pieces 16 creates a slot or gap between the end cap pieces 18 and the flat plate piece 14. The resulting slot allows the outer edges of multiple cards 10, typically 5 to 20 cards, to be held in place while also allowing these card(s) to be removed and replaced easily. The additional width at one end of each of the middle spacer pieces 16 prevents the cards from sliding out the back of the device when the cards are slid into place. The holding pressure of the end cap pieces 18 is created by the thickness of multiple cards 10 when the cards are inserted into the slot or gap created by the middle spacer pieces 16. The resulting pressure applied to the cards 10 will depend on the exact number of cards inserted into the device by the user. The position and shape of the end cap pieces 18 allow the outer card to be in full view to the user.

The back side of the flat plate piece 14 has a pressure sensitive adhesive applied which allows the device to be attached to numerous types of surfaces. The attachment is typically permanent, unless the adhesive is providing a connection to a piece of Velcro material which is similar in surface area as the flat plate piece 14 which would then provide a temporary or moveable attachment.

FIGS. 2A–2D—Additional Embodiments

The same as the preferred embodiment, but manufactured as a single piece of plastic via injection molding and or machining techniques. This method of manufacture would require a thin slot or slit to be cut between the inner and outer portions where the card edges would be held in place.

Operation—FIGS. 1–5

The manner of using the present invention is very simple and consists of the user removing the stick resistant paper on the back of the flat plate piece 14 which covers the pressure sensitive adhesive, and pressing the device against any surface and location desired by the user. The user can then insert a relatively small number of cards, typically five to twenty cards, into the slot between the flat plate piece 14 and the outer end caps 18. The outer card will always be in full view of the user. The user can then remove and replace any number of cards desired from and back into the device.

Conclusion, Ramifications, and Scope

Thus the reader will see that the present invention provides a very convenient means for users of all ages to store and access index cards in numerous locations thus allowing the user to complete tasks in a more organized and efficient manner.

No other index card holding devise allows the user to keep their cards in so many convenient locations with the outer card in full view and fully accessible to write on.

Not only are the index cards stored in a place which makes it hard to forget, but they can be accessed very easily when new ideas come to mind and need to be written down. The present invention allows the user to remove and replace cards into and out of the device very easily without having to open a flap or cover.

Some of the many advantages of the present invention over prior art have been described above, but a few of the improved capabilities and uses for the user include: convenient access of To Do lists, convenient access of check lists or procedures, convenient means to record ideas immediately before they are forgotten, or storage of very important reminders and motivational sayings. Now the excuse of "Out of sight, Out of mind" is no longer valid.

The invention can be made of various types of plastic or metal. Plastic appears to be the most logical and economical choice in terms of costs and ease of manufacturing. The costs required by a user to purchase this device would be minimal, especially compared to the potential savings in time and money that can result from not forgetting to do important tasks.

Accordingly, the scope of the present invention should be determined not by the embodiments illustrated, but by the claims and their legal equivalents.

I claim:

1. An index card holding device which is attached to the surface of an object comprising:

(a) an inner flat plate piece slightly larger in area than card or cards to be held, and (b) two middle spacer pieces, and (c) two outer end cap pieces, and (d) pressure sensitive adhesive connecting said flat plate piece to said object, and said middle spacer pieces to said flat plate piece, and said outer end cap pieces to said middle spacer pieces, (e) said outer end cap pieces and said inner flat plate piece adapted to secure said card or cards to said object so as to enable said card or cards to be removed and replaced conveniently, (f) wherein said flat plate piece, said middle spacer pieces, and said outer end cap pieces are composed of plastic or metal.

* * * * *